US011564442B2

(12) United States Patent
Kyle

(10) Patent No.: US 11,564,442 B2
(45) Date of Patent: Jan. 31, 2023

(54) SHOE DEVICE WITH BIMODAL STRUCTURES FOR RAPID ENTRY AND RELEASE

(71) Applicant: Kentigern Kyle, Naples, FL (US)

(72) Inventor: Kentigern Kyle, Naples, FL (US)

( * ) Notice: Subject to any disclaimer, the term of this patent is extended or adjusted under 35 U.S.C. 154(b) by 0 days.

(21) Appl. No.: 17/208,326

(22) Filed: Mar. 22, 2021

(65) Prior Publication Data

US 2021/0204643 A1 Jul. 8, 2021

Related U.S. Application Data

(63) Continuation-in-part of application No. 16/120,899, filed on Sep. 4, 2018, now Pat. No. 11,000,091.

(60) Provisional application No. 62/694,484, filed on Jul. 6, 2018, provisional application No. 62/553,326, filed on Sep. 1, 2017.

(51) Int. Cl.

| | |
|---|---|
| ***A43B 11/00*** | (2006.01) |
| ***A43B 23/02*** | (2006.01) |
| ***A43B 3/12*** | (2006.01) |
| ***A43B 21/26*** | (2006.01) |
| ***A43B 13/14*** | (2006.01) |
| ***A43B 13/18*** | (2006.01) |

(52) U.S. Cl.

CPC ..... *A43B 11/00* (2013.01); *A43B 3/128* (2013.01); *A43B 13/141* (2013.01); *A43B 13/183* (2013.01); *A43B 21/26* (2013.01); *A43B 23/028* (2013.01)

(58) Field of Classification Search

CPC ..... A43B 11/00; A43B 3/126; A43B 3/128; A43B 3/242; A43B 3/246; A43B 23/027

See application file for complete search history.

(56) References Cited

U.S. PATENT DOCUMENTS

| | | | | |
|---|---|---|---|---|
| 10,653,209 | B2 * | 5/2020 | Pratt | A43C 11/004 |
| 2008/0189984 | A1 * | 8/2008 | Januszewski | A43B 3/242 36/11.5 |
| 2011/0016751 | A1 * | 1/2011 | Somerville | A43B 3/122 36/105 |
| 2011/0146106 | A1 * | 6/2011 | Kaufman | A43C 11/00 36/43 |
| 2017/0360143 | A1 * | 12/2017 | Pratt | A43B 11/00 |
| 2020/0000178 | A1 * | 1/2020 | Pratt | A43C 11/004 |
| 2020/0205520 | A1 * | 7/2020 | Kilgore | A43B 23/088 |
| 2020/0214392 | A1 * | 7/2020 | Pratt | A43B 3/248 |
| 2021/0068493 | A1 * | 3/2021 | Pratt | A43B 23/0275 |
| 2021/0112911 | A1 * | 4/2021 | Pratt | A43C 11/14 |

* cited by examiner

*Primary Examiner* — Ted Kavanaugh

(57) ABSTRACT

A shoe device having bimodal structures, configured to selectively snap the device to at least one of a second position and a first position, which selectively snaps the shoe into a first position upon being subjected to a first bending force, apt for placement or removal of a foot, and selectively snaps the shoe into a second position upon being subjected to a second bending force, apt for securement of a foot or having no foot. A forward leaning, flexible stadium arch structure, assembled to form a heel notch mechanism, connects to a sole. A morphing shoe collar portion connects to a heel. These are combined via vector changing devices for greater functionality.

3 Claims, 7 Drawing Sheets

SHOE DEVICE WITH BIMODAL STRUCTURES FOR RAPID ENTRY AND RELEASE

CROSS-REFERENCE TO RELATED APPLICATIONS

This application is a continuation-in-part of co-pending parent U.S. Nonprovisional patent application Ser. No. 16/120,899, filed Sep. 4, 2018, and claims the benefit of U.S. Provisional Patent Application Ser. No. 62/694,484, filed Jul. 6, 2018, and U.S. Provisional Patent Application Ser. No. 62/553,326 filed Sep. 4, 2017, which by reference are incorporated herein in their entirety.

FIELD OF THE INVENTION

The present disclosure is generally directed to shoes, and more particularly to a bimodal shoe or sandal, or other foot related mechanical device, that allows a user to conveniently don and doff a shoe or device in fast or hands-free fashion.

BACKGROUND OF THE INVENTION

It common for individuals to wear shoes, such as running shoes or tennis shoes. A shoe usually has a fastening arrangement that allows a user to fasten their shoe to their foot. For example, such fastening arrangements may include straps, shoe laces, or zippers.

However, existing shoes are problematic because their fastening arrangements are too complicated, unreliable, ugly, and take too much time to fasten shoes. For example, assuming a shoe lace is already threaded through a shoe, the shoe lace has to be pulled and tied in a doubly slipped reef knot formed by joining ends of the shoe lace. Straps with hook and loop fasteners are faster to secure than shoe laces, but straps are not durable and many consider them ugly. Zippers are uncomfortable to use and are known to break and come loose.

Other types of shoes have evolved that have no straps or fastening devices, and thus permit rapid donning, such as flip flops, sandals, or clogs. However, these shoe designs by lacking securement systems of the back heel often do not provide the necessary stability to the foot to permit safe running or active use. Further, these designs are often cited for causing numerous injuries and falls.

Other types of shoes have evolved that are rapidly donned that do have some kind of support provided to the back heel, such as shoes made of flexible material similar to pull-on water shoes, or shoes with flexible heel straps of varying designs, for example rubber clogs. However, these shoe designs require the dedicated use of hands, with the user required to sit or bend down to fasten the heel securing device.

Other types of shoes have evolved that are designed to be quicker and easier to don on and off, with minimal use of hands, without sitting or bending down to fasten or unfasten the shoe. However, these designs utilize complicated snaps, wheels, ratchets, magnets, mainsprings, pulleys, electric motors, common structures with loops and connection points, pivotally movable straps with support brackets, metal bands, metal springs, and other designs that are not cost effective to produce using single, widely used materials in the footwear industry such as natural, urethane, or silicone rubbers or ethylene-vinyl acetate and similar polymers.

Therefore there exists a need for an improved shoe that is quicker and easier to don and doff in comparison to existing shoe designs, with minimal use of hands, without sitting or bending down to fasten or unfasten the shoe, that permit the use of active motion such as running or active walking without possibility of injury or stumbling, have a functional bimodal spring mechanism activated by multiple pressure points that can be easily used by the consumer, and are cost effective to produce using single, widely used materials in the footwear industry such as natural, urethane, or silicone rubbers or ethylene-vinyl acetate and similar polymers.

SUMMARY OF THE INVENTION

This summary is provided to introduce a selection of concepts in a simplified form that are further described below in the detailed description. This summary is not intended to identify all key features or essential features of the claimed subject matter, nor is it intended to be used to limit the scope of the claimed subject matter. Furthermore, the claimed subject matter is not limited to implementations that solve any or all disadvantages noted in any part of this disclosure. The invention as disclosed incorporates a multitude of concepts that some or all of which can combine to collectively solve the challenges as defined. These concepts and related features and elements as well as the operation of the disclosed embodiments will become more apparent in light of the following description of various embodiments and accompanying drawings. The invention as disclosed incorporates a multitude of concepts that some or all of which can combine to collectively solve the challenges as defined.

Disclosed is a bimodal shoe, defined as shoe device or other similar foot device that can incorporate the benefits of the designs defined below including but not restricted to structures such as shoes, boots, sandals, clogs, skis, snowboards, skates, skateboards, flippers, paddle board foot areas, or other similar structures, the bimodal shoe comprising, a bimodal structure, the bimodal structure configured to selectively snap to a second position and a first position, wherein the bimodal structure has incorporated convex and concave positions, either or both positions with stored kinetic potential (e.g. elastic potential energy), wherein the bimodal structure utilizes the tensile properties of materials shaped in spherical, curved, or semi-spherical forms, wherein the forms can be changed from one position to the other by directional force from multiple sides (e.g. lateral forces directed to a pressure point), wherein the directional force is applied to a pressure point causing the structure to change positions upon a threshold directional force being applied.

In one aspect, the bimodal structure can be activated to snap into the first position causing an opening of the bimodal shoe formed by the top line, collar or collar wall to change for receiving a foot in the bimodal shoe.

In another aspect, causing the bimodal structure to snap into the second position causes an opening of the bimodal shoe formed by the top line, collar, or collar wall to change for securing a foot received in the bimodal shoe.

In another aspect, causing the bimodal structure to snap into the first position causes a heel counter of the shoe to pivot.

In another aspect, causing the bimodal structure to snap into the first position causes a heel counter to deform.

In another aspect, the bimodal structure is curved in at least one of the second position and the first position.

In another aspect, the bimodal structure is concave in at least one of the second position and the first position.

In another aspect, the bimodal structure is concave in one of the second position and first position, and convex in another one of the second position and first position.

In another aspect, the bimodal structure is located at or in the sole of the bimodal shoe.

In another aspect, the bimodal structure is located at a heel counter of the bimodal shoe.

In another aspect, the bimodal structure is located at a sole of the bimodal shoe such that stepping in the shoe with a user's foot while the bimodal structure is in the first position causes the bimodal structure to snap into the second position.

In another aspect, mechanisms permit directional force to be applied in a hands free fashion to pressure points required to activate the bimodal structure comprised of, a heel counter based pivot system that changes downward pressure on a heel tab into upward pressure to a sole based bimodal structure at its activation pressure point, a rear sole or flared heel based system that changes downward pressure on the heel tab into pressure to the bimodal structure at its activation pressure point.

In another aspect, the bimodal structure of the heel counter variations contain two side arms or bands that separate and cause the heel notch and shoe opening to become larger for receiving a foot and vice-versa.

In another aspect, the bimodal shoe contains a back tab or shape that forms part of a lever, that by using the back sole and heel portion in connected fashion, creates a lever converting downward pressure on the tab or shape into upward pressure to the singular pressure point that can activate the bimodal structure.

In another aspect, the bimodal shoe contains a back sole area that rises upwards behind the heel counter, converting downward pressure on the back tab or shape into upward focused pressure to the singular pressure point that can activate the bimodal structure.

In another aspect, flexible areas of the body of the shoe or shoe-like structure traverse from a narrower portion of the shoe to a wider portion of the shoe, such that when the bimodal structure is activated the opening of the shoe is increased or decreased.

In another aspect, the heel counter variations may contain a separation between the bimodal structure forming the heel counter and the sole area below.

In another aspect, a heel counter variations includes two side arms that separate and cause the heel notch or shoe opening to become larger for receiving a foot and vice-versa when the bimodal structure moves to the first position.

In another aspect, the heel counter may contain a separation between the bimodal structure forming a heel counter and a sole area below.

In another aspect, the shoe can incorporate one or a combination of bimodal structures depending on the desired functionality, design, and aesthetics of the bimodal shoe.

In another aspect, a bimodal structure is a stadium arch.

In another aspect, the stadium arch comprises two side arm bands and a connected heel tab area, forming a forward-leaning, flexible band in the shape of a curved arch, manufactured as a generally tubal, or thick band-like strap, being forward-leaning as manufactured, relative to the plane of the horizontal sole, a curved, symmetrical structure spanning laterally the central portion of a shoe, connected to the sides of a sole of a footwear device at anchor points at the mid or rear region of a shoe via a clasp, grommet or formed as one structure, exhibiting in some sections a moon-shaped cross-section profile, with a slight degree of inward concavity directed towards the longitudinal center line of the shoe, said flexible arch being a forwardly inclined stadium arch with known mechanical properties.

In another aspect, the stadium arch may be manufactured of a material with tensile properties similar in nature to plastics, sheet metals, urethane and silicone rubbers, natural rubber, or Ethylene Vinyl Acetate or similar polymers, wherein portions can be changed from a stable position to an unstable position by directional force from different sides and directions, in which the form seeks to return to a native position due to inherent elastic and morphing properties. Alternatively, the stadium arch may be constructed of non-elastic elements but with added elastic elements. The form and shape of the arch is sized to the anatomical features of the end users foot.

In another aspect, the top or apex of the stadium arch is shaped as to form a heel notch area, with a cross-section profile similar that of a half circle or curved quarter moon shape, as to create a slightly curved receiving area for the Achilles portion of a heel. In a preferred embodiment, the arch is manufactured such that an imaginary spinal line as reference point of the line formed by the apex points of the inner curved portions of the heel notch, being the uppermost diameter line of the half circle cross section profile shape, is at approximately 135 degrees to the plane of the sole of the shoe, representing the stadium arch's manufactured position.

In another aspect, the stadium arch is anchored to the two sides of the sole at a point below the top surface area of the insole, being the midsole, or outer sole, formed as one part during manufacture, or affixed with anchoring clasps, bolts, grommets or plugs at the sole.

In another aspect, a gap exists between the stadium arch and the portions of the sole, or insole, or midsole, higher than the anchor points of the stadium arch.

In another aspect, the stadium arch is sized such that when rearward and downward vertical force is applied, the heel notch section bends backward towards the rear of the shoe, forming the rear shoe top line of a foot insertion cavity, and at one point in its trajectory occupies the anatomically correct space at which it is positioned to envelope a lower portion of the Achilles, and the fleshy region of the heel above a rear portion of the Calcaneus, with an inserted and secured foot of a user of a typical footwear device, with the reference spinal line being approximately 45 degrees to the plane of horizontal sole, forming a functional heel notch and heel strap, as to secure a foot, representing the stadium arch's assembled position.

In another aspect, the stadium arch is sized such that when rearward and downward vertical force is applied, the heel notch section occupies a backwardly position at the rear of the shoe and flared heel, and at this point in its trajectory occupies the space at the rear of the sole, with the lower lip of the heel notch section positioned at the top rear of the sole and flared heel, with the reference spinal line being approximately a 135 degree angle relative to the horizontal sole, forming a functional shoe horn device, representing the stadium arch's flexed position.

In an embodiment of a shoe, the stadium arch, during assembly, is pulled downward back towards the rear of the sole to its assembled position, and connected to the rear back of the sole with cord, strap, string, cable, chain, string, rope, or lines, to the sole with a clasp, as to position the arch to form a functional heel notch to secure a heel.

In another aspect, the connecting cord and clasp incorporates a mechanism to regulate and adjust their size, such as shoe laces, a bar and prong buckle, tri-ring buckle, loop, slide bar buckle, cord locks, cord wheels, velcro strap, cam buckle, pressure spring snap, or other device of similar mechanical properties.

In an alternative embodiment of a shoe, the stadium arch, during assembly, is pulled downward back towards the rear of the sole to its assembled position, and connected to a solid enveloping heel counter, or portions thereof, with cord, strap, string, cable, chain, string, rope, lines, to the sole with a clasp, as to position the arch to form a functional heel notch to secure a heel.

In another aspect, the heel cover, comprising a heel counter, is constructed of a morphable material, that may contain slips or slots to improve its ability to collapse rearward and outward.

In another aspect, the heel cover, comprising a heel counter, may demonstrate a forward concavity and an alternative morphed rearward convexity.

In an another aspect, a bimodal structure is a front shoe collar portion.

In another aspect, the shoe collar portion includes the front shoe collar and a tongue section, in one position surrounding the top portion of the forefoot of a wearer's foot, forming the fronting section of a foot insertion cavity, with dual rearward facing arms or bands stemming from the upper section directed rearward forming the side sections of a foot insertion cavity. The shoe collar portion may be manufactured of a material with tensile properties similar in nature to plastics, sheet metals, urethane and silicone rubbers, natural rubber, TPU or Ethylene Vinyl Acetate or similar polymers, wherein portions can be changed from a stable position to an unstable position by directional force from different sides and directions, in which the form seeks to return to a native position due to inherent elastic and morphing properties. Alternatively, the shoe collar portion may be constructed of nonelastic elements but with added elastic elements. The shoe collar portion and side arms are manufactured with a widened opening for inserting a foot, sized larger and looser than the normal anatomical size as to tightly grip a foot in an inserted and fastened shoe. In other words, the portion of the upper that typically rests above the rearmost portion of the forefoot, comprising the front shoe collar or tongue, when a footwear device is securely fastened to a foot, is designed and manufactured as to be in a native position at a more elevated state relative to this aforementioned position, forming a larger foot insertion cavity, and in this native position the arms are angled to a slight rearward and outward direction relative to the longitudinal direction of the sole as to also create an enlarged foot insertion cavity, representing the shoe collar portion's manufactured position.

In another aspect, the lower side walls of the shoe and the shoe collar portion are separated at the top forefoot area, and connected further towards the front of the shoe, with a diminishing gap separating the lower side walls of the shoe and the shoe collar portion, designed to form a receiving space of similar shape and volume of portions of the shoe collar portion that occupy this space if positioned downward, lower than its native manufactured position.

In an alternative embodiment of a shoe, dual side arms hereafter referred to as a "connecting element" join the morphable shoe collar portion, with clasp(s) at the terminating ends, to movable portions of the heel of a shoe. The shoe is assembled with the connecting element providing tension to the downwardly stressed shoe collar portion, allowing said structure to move upon movement at the heel between a first closed position, a second, flexed, open position, and a plurality of heel and forefoot embracing positions.

In another aspect, the connecting element passes through vector changing devices located at the rear of the shoe.

In another aspect, the vector changing device is a hole, tunnel, loop, strap, hook, wheel, or other device of similar mechanical property, at, or attached to the sole as to change the pulling direction of the connecting element.

In an alternative embodiment of a shoe, disclosed is a shoe, manufactured with a forward leaning stadium arch, an upper with morphable shoe collar portion, a toe box portion, a sole structure, and dual side arms as connecting elements joining the flexible stadium arch and morphable shoe collar portion, with clasp(s) at the terminating ends, or a heel counter as clasp. The shoe is assembled with the connecting element providing tension to the stadium arch and shoe collar portion, allowing said structures to move between a first closed position, a second, flexed, open position, and a plurality of heel and forefoot embracing positions.

In another aspect, the connecting element passes through a vector changing device.

In another aspect, the connecting element(s) formed and originating from the shoe collar portion contain circular ends with a doughnut hole, and are fastened to clasps located at the rear of the heel notch of the stadium arch.

In another aspect, the connecting element(s) formed and originating from the heel notch contain circular ends with a doughnut hole, and are fastened to clasps located at top of the shoe collar portion.

In another aspect, design and materials of the shoe are such that the tensional pulling force transmitted axially by the means of a cord, strap, string, a cable, chain, or similar object required to pull the top edge of the shoe collar portion downward until it fully or partially resides in the gaps above the side walls left at manufacture, is roughly equal or less than to pull the top heel notch section of the stadium arch backwards and downwards until the heel notch of the arch is positioned at the typical area at which to envelope the lower portion of the Achilles, and the fleshy region of the heel above rear portion of the Calcaneus, with an inserted and secured foot of a user of a footwear device.

In another aspect, after manufacture and during assembly, the stadium arch and shoe collar portion are both pulled downward to assembled positions, and connected by the connecting element of size and material as to maintain the stadium arch and shoe collar in these positions.

In another aspect, the connecting bands are individual elements made of cord, strap, string, cable, chain, string, rope, lines, or other similar devices of similar mechanical properties.

In another aspect, the connecting bands are made of the same material as the shoe.

In another aspect, the connecting straps form part of the shoe collar portion.

In another aspect, the connecting straps form part of the stadium arch.

In another aspect, the connecting straps pass through a vector changing device located at the midpoint or rear of the shoe.

In another aspect, the vector changing device is a hole, tunnel, loop, strap, hook, wheel, or other device of similar mechanical property, at, or attached to the sole as to change the pulling direction of the connecting element.

In another aspect, the vector changing device comprises two holes, with an angled, central, transversal bar incorporated within each hole, each hole located at the rearmost corners of the sole.

In another aspect, the connecting bands incorporate a mechanism to regulate and adjust their size, such as shoe laces, a bar and prong buckle, tri-ring buckle, loop, slide bar buckle, cord locks, cord wheels, velcro strap, cam buckle, pressure spring snap, or other device of similar mechanical properties, which may be placed at the shoe collar portion, between the shoe collar portion and the stadium arch, or at the stadium arch.

In another aspect, disclosed mechanisms permit downward force to the stadium arch forming the upper heel counter in its assembled position to occupy a lower position in its trajectory to its flexed position, causing: an enlarged opening of foot insertion cavity of the bimodal shoe for receiving or removing a foot in the bimodal shoe, formed by a lower positioned heel notch portion of the stadium arch; and slackened connecting elements; with slackened elements positioning an elevated shoe collar portion; and an enlarged opening of foot insertion cavity formed by the elevated shoe collar portion for receiving or removing a foot in the bimodal shoe, representing a second or "open" position.

In another aspect of the alternative embodiment, disclosed mechanisms permit upward-pulling tension of the material forming heel notch of the stadium arch forming the upper heel counter returning to its assembled position as a functional heel notch, causing: a diminished opening of foot insertion cavity of the bimodal shoe for securing a foot in the bimodal shoe, formed by a raised heel notch portion of the stadium arch; tightened connecting elements; tightened connecting elements positioning a lowered shoe collar portion; and a diminished opening of foot insertion cavity formed by a lowered shoe collar portion for securing a foot in the bimodal shoe, representing a first or "closed" position.

In other words, when a shoe is being donned a lowered position of the heel notch of the stadium arch permits an increase of stored tension of the stadium arch, and a rising shoe collar portion with decreased tension, such that when the heel notch tension is released, with a fully inserted foot fully slid into the foot insertion cavity, being aided by the shoe horn aspect of the heel notch, being aided by the elevated shoe collar portion, it is positioned higher, with tightened connecting elements, and a lowered shoe collar portion with increased tension firmly gripping the rear, top portion of a user's forefoot, thus transitioning a bimodal shoe from a first position to a second position with a partially inserted foot, or an opening apt for removing or placing a foot, to a first position with a fully enclosed foot or without a foot.

In another aspect of the alternative embodiment, areas of the body of the shoe present a fully formed heel counter and solid side walls and upper of EVA, mesh, cloth, rubber, leather, spandex, neoprene, synthetics and other standard shoe materials, encapsulating the principal fastening elements described herein including the stadium arch with heel notch, shoe collar portion, and connecting elements, permitting a wide range of styles and shoe types.

These and other objects, features, and advantages of the present invention will become more readily apparent from the attached drawings and the detailed description of the preferred embodiments, which follow.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views. The preferred embodiments of the invention will hereinafter be described in conjunction with the appended drawings provided to illustrate and not to limit the invention, where like designations denote like elements, and in which.

DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
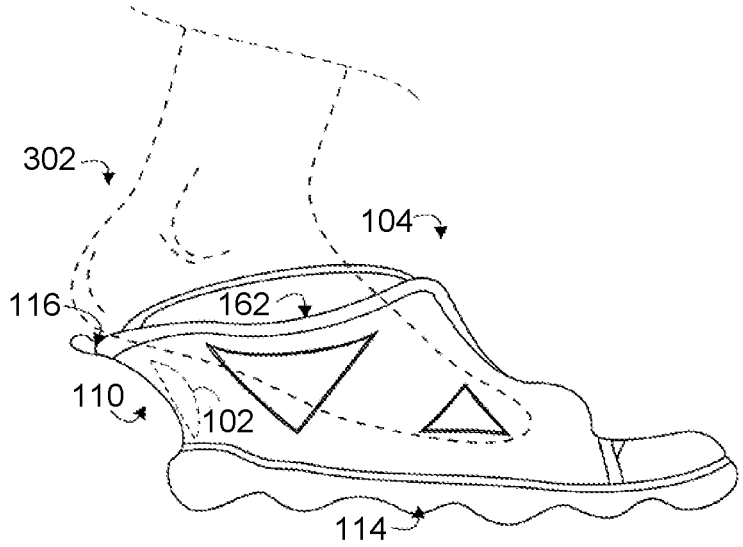
FIG. 3 presents a side perspective view of an exemplary bimodal shoe of FIG. 1, including a bimodal spherical structure at heel counter of the bimodal shoe, where the shoe is being donned, in accordance with aspects of the present disclosure.

As shown throughout the figures, disclosed is a bimodal shoe 100. The bimodal shoe 100 may include a bimodal structure 102. The bimodal structure 102 may be configured to selectively snap to a first position 104 and a second position 106. The bimodal structure 102 may take any appropriate form such as a stadium arch or similar shapes all of varying scalings. The bimodal structure may be an added element to the shoe or may be incorporated into the structure of the shoe itself. The bimodal structure may span between both a heel counter and a sole of a shoe. For example, FIG. 3 presents a perspective view of a bimodal structure that is attachable to both a heel counter and a sole of a shoe, having arms that separate when moving between a first and second position.

It is to be understood, that the bimodal shoe 100 may be embodied as a sandal or any appropriate footwear.

An opening 108 of the bimodal shoe 100 may open, expand, or separate, in response to the bimodal structure 102 snapping into the first position 104 starting from the second position 106. The opening 108 may close, contract, or come together in response to the bimodal structure 102 snapping into the second position 106 starting from the first position 104. Therefore, causing the bimodal structure 102 to snap into the first position 104 may cause the opening 108 of the bimodal shoe 100 to change for receiving a foot 302 in the bimodal shoe 100. Further, causing the bimodal structure 102 to snap into the second position 106 may cause an opening 108 of the bimodal shoe 100 to change (e.g. become smaller) for securing a foot 302 already received in the bimodal shoe 100. It is understood that numerous parts of the shoe such as the shoe wall, sole, heel counter, top lines, quarter panel, tongue, midsole, or stitch seam made of material with or without flexible properties, will be deformed, pushed, pulled, tightened, stretched, constricted or otherwise change structure depending on the different states 104 or 106, and said shoe structures will aid in the securing or removal of the shoe to the foot 302, with the possible addition of strings, laces, straps, loops, belts, elastics, ribs, ropes, and other forms, and these variations of construction do not represent a unique utility, nor represent a distinction from the basic functionally derived from the bimodal shoe as described in this disclosure. A wearer may press their foot 302 applying downward pressure into the bimodal shoe 100 when the bimodal structure 102 is in the first position 104 to cause the bimodal structure 102 to adopt or snap into the second position 106 and secure the wearer's foot 302 in the shoe by causing the opening 108 to secure the wearer's foot (e.g. grip the foot or ankle), hands-free.

Figure 1:
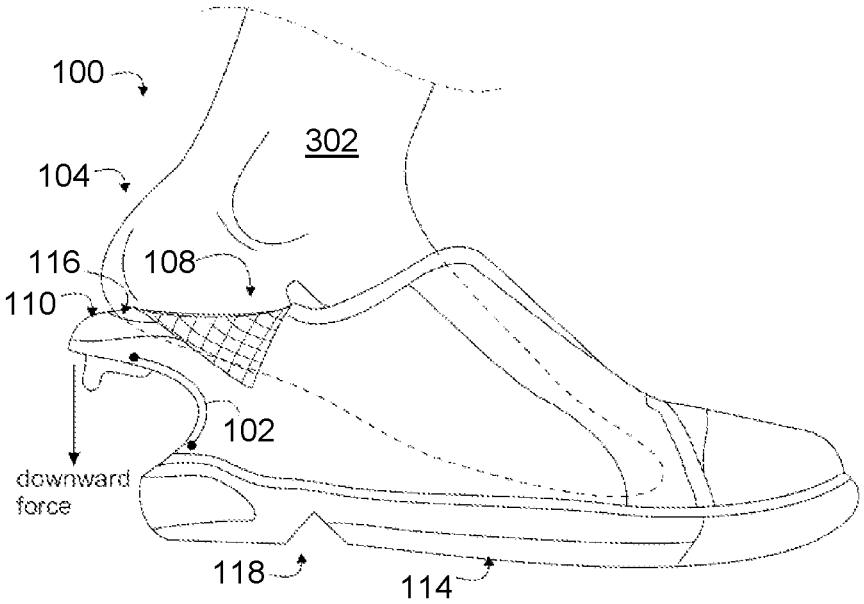
FIG. 1 presents a side perspective view of an exemplary bimodal shoe including a bimodal clasp at a heel counter of the bimodal shoe, where the shoe is being donned, in accordance with aspects of the present disclosure.

The illustrations show various ways the opening responds to various configurations of the bimodal structure adopting the second position 106 and the first position 104. For example, the opening 108 may expand backwardly with respect to a front of the bimodal shoe 100. Likewise downward pressure causing the bimodal structure 102 to snap into the first position 104 may cause a heel counter 110 of the bimodal shoe 100 to pivot downward. As shown in FIGS. 1, 3, causing the bimodal structure 102 to snap into the first position 104 may cause a heel counter 110 to deform. Therefore, to deform the opening 108, the heel counter 110 may pivot from or near a vicinity of the bimodal structure 102, or alternatively the heel counter 110 may deform, depending on where the bimodal structure 102 is located.

In embodiments where the bimodal structure 102 is located to cause the heel counter 110 to deform: as shown in FIGS. 1,3, the bimodal structure 102 may extend from or near the sole 114 to the upper portion 116 of the heel counter 110. The back portion of the rear heel collar 161 may be separated from the sole as to enable an upward or downward deformation when the bimodal structure is activated.

Figure 4:
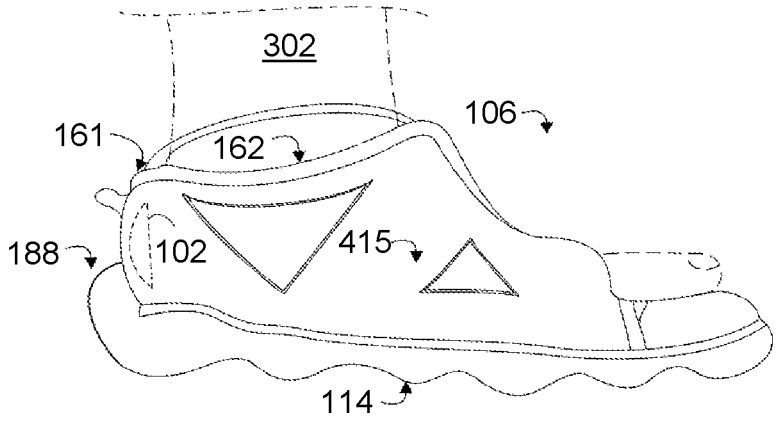
FIG. 4 presents a side perspective view of an exemplary bimodal shoe of FIG. 1, where the shoe has been donned, in accordance with aspects of the present disclosure, including a bimodal spherical structure at the heel counter of the bimodal shoe, in accordance with aspects of the present disclosure with the detachable portion of the bimodal structure permitting the bimodal structure to deform upward, and further permitting the heel of the user to come down directly on the pressure point when the shoe is to be donned, in accordance with aspects of the present disclosure.

As shown in FIG. 4 the sole 114 may extend externally up to the middle portion 116 of the heel counter 110, forming back flared heel area 188 or back sole that rises upwards behind the heel counter, converting downward pressure on the back tab or shape into focused pressure to the singular pressure point that can activate the bimodal structure 102.

As shown in FIGS. 1, 3, a downward force on the upper portion 116 of the heel counter or heel tab 110 may cause the bimodal structure 102 to curve inwardly toward a front of the bimodal shoe, causing the bimodal structure 102 to adapt the first position 104.

Figure 2:
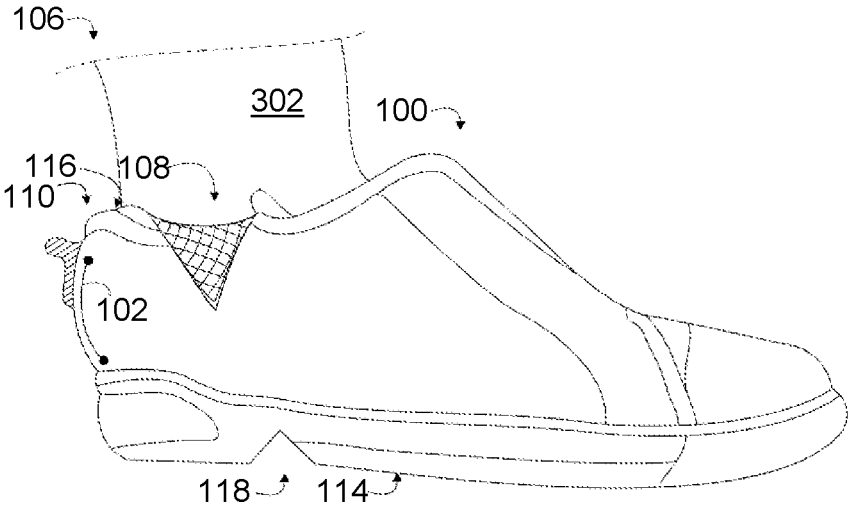
FIG. 2 presents a side perspective view of the exemplary bimodal shoe of FIG. 1, where the shoe has been donned, in accordance with aspects of the present disclosure.

The bimodal structure 102 may be configured such that the bimodal structure 102 has a higher elastic potential energy stored as a result of being deformed to one of the second position 106 and the first position 104. In other words, the bimodal structure is a bendable structure that selectively snaps into the first position upon being subjected to a first bending force or displacement (e.g. at a pressure point), and that selectively snaps into the second position upon being subjected to a second bending force or displacement (e.g. at a pressure point), where the first bending force or displacement has an opposite direction to the second bending force or displacement. Therefore, in the second position 106 and first position 104 the bimodal structure 102 may be selectively locked into a stable and tensioned first or second position, while still holding its higher elastic potential energy. This configuration allows a user to overcome a threshold tension held by the bimodal structure 102 in the first or second positions to cause the bimodal structure 102 to move and subsequently selectively lock and snap into an opposite first or second position. For example, a user may simply press their foot into the shoe to snap the bimodal structure into the second position, and use their other foot to apply a downward lever-like force on a heel of the shoe while the shoe is already donned to cause the bimodal structure to snap out of the second position and/or snap into the first position (e.g. see FIGS. 1,2. For example, a front of the user's foot may press against a top of the shoe opening, causing a general fulcrum point about a longitudinal center of the shoe, allowing the user to subsequently apply a lever force downwardly using their other foot on a heel of the shoe to cause the shoe to snap out of the second position. In other words, a front of a user's received foot (e.g. stepping on the ball of their foot, raising their own foot heel) applies an upward force (e.g. attempting to raise) to the shoe while the other foot can be used to snap the shoe out of the second position by applying a downward force onto the heel. For example, the bimodal structure is configured such that a net downward force applied to a heel counter of the bimodal shoe while the user's foot is received in the bimodal shoe, and while the user applies an upward force using a top of their foot by raising their heel and keeping the ball of their foot planted, causes the bimodal structure to snap out of the second position. Therefore, a net downward force (or displacement of) on the heel counter with respect forward, or other, portions of the shoe snaps the shoe out of the second position. In other words, holding frontal portions (or portions in front of a pivot point, or pressure point) of the shoe in place while applying a downward force on the heel causes the bimodal structure to snap out of the second position. A downward force applied to a heel counter of the bimodal shoe while holding portions of the shoe forward from the bimodal structure and away from the heel counter stationary causes the bimodal structure to snap out of the second position and into the first position. This allows the bimodal shoe to be doffed hands-free by snapping out of the second position.

As shown in FIGS. 1-4, the bimodal structure 102 may be located at a sole 114, midsole, heel corner (e.g. where the heel and the sole meet) or foot bed of the bimodal shoe 100, or a combination thereof. For example, the bimodal structure 102 may be located below a wearer's actual foot heel, or actual foot sole, such that the wearer's heel may apply force to the bimodal structure 102 when it is in the first position 104 to cause the bimodal structure 102 to lock into the second position 106 for donning the shoe hands-free.

As shown in FIGS. 3,4, the bimodal structure 102 may be located at a heel counter 110 of the bimodal shoe 100 demonstrating a concavity similar to the back of a heel, in a semi-sphere shape. As part of the heel counter 110, the bimodal structure may include a curved, inverting portion and an upper portion. The upper portion may include two side bands 162 that are attached to the opening 108 such that when the bimodal structure switches from the second position 106 to the first position 104 the arms of the bimodal structure 102 separate and cause the opening to become larger for receiving a foot. Additionally, the bimodal structure may be configured for the opposite to occur.

As shown in FIG. 4, the upper formed of the front shoe collar section 415 and provide the front section of a foot insertion cavity.

As shown in FIGS. 5,8,9,11,12, 13, a bimodal structure is a stadium arch 401.

As shown in FIGS. 10,11,12,13, a bimodal structure is a shoe collar portion with arms.

Figure 5:
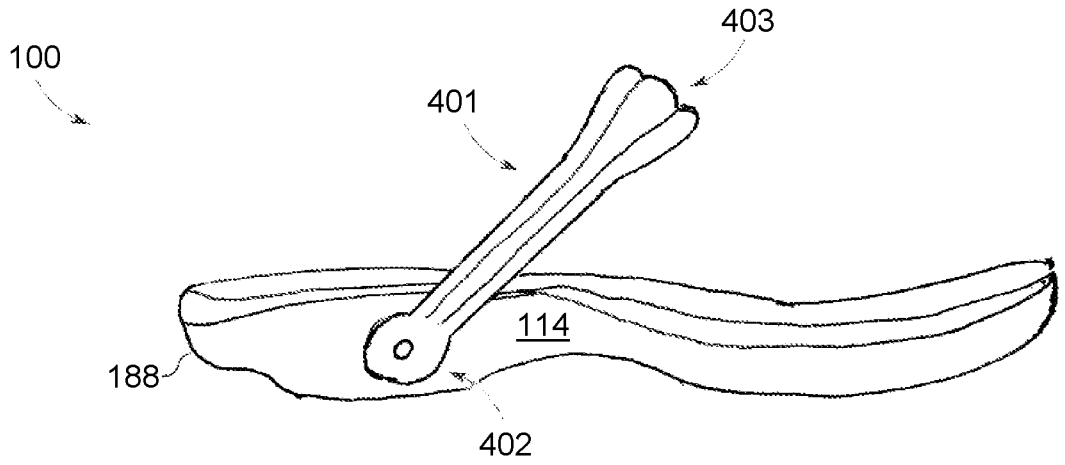
FIG. 5 presents a side perspective view of an exemplary bimodal shoe sole and stadium arch bimodal structure in manufactured state, in accordance with aspects of the present disclosure.

As shown in FIG. 5, the stadium arch is anchored to the sides of a sole 114 at a position below the foot-bed at anchor point 402. The portion of the stadium arch above anchor point 402 and below the foot-bed of shoe 100 are not connected. The apex portion of the of the stadium arch forms a heel notch 403, with an enlarged portion apt to envelope the heel of a user's foot.

Figure 6:
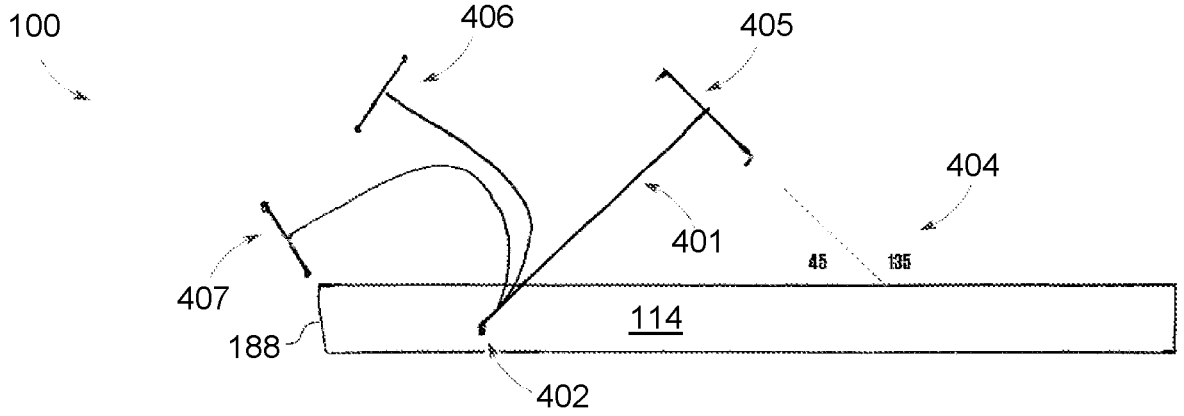
FIG. 6 presents a side perspective view of a conceptual illustration of multiple geometric angles of the heel notch spinal line, using commonly accepted principles of fractions of a circle wherein the whole circle is 360 degrees, of sample positions of the plurality of positions of the stadium arch bimodal structure, as shown in the exemplary bimodal shoe sole of FIG. 5, in accordance with aspects of the present disclosure.
Figure 7:
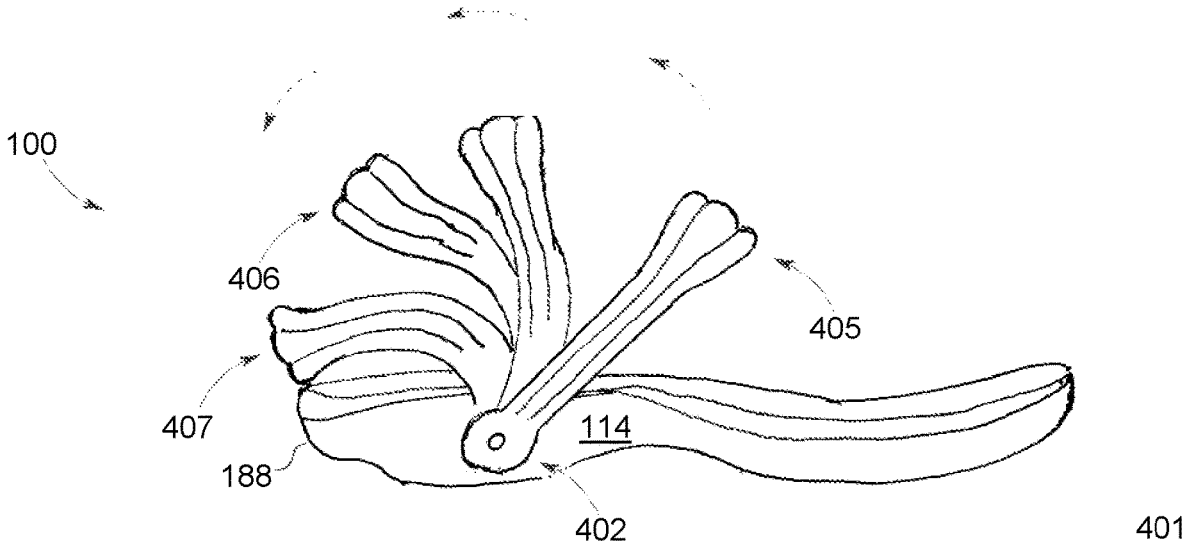
FIG. 7. presents a side view of a conceptual illustration of the exemplary bimodal shoe sole of FIG. 6, demonstrating sample positions of the plurality of positions of the stadium arch bimodal structure, as shown in the exemplary bimodal shoe sole of FIG. 5, in accordance with aspects of the present disclosure, in accordance with aspects of the present disclosure.

As seen in FIG. 6,7, the stadium arch is manufactured at approximately a 45 degree angle relative to the plane of the sole. The arch is sized, and with a specific anchor point 402 placement, such that, when rearward forces providing a plurality of rearward positions as referenced in FIG. 7 by directional arrows, the arch is displaced to positions 405, 406, 407, with the distance between anchor point 402 and point 405 being greater than the distance between anchor point 402 and 406, and the distance between anchor point 402 and 406 is greater than the distance between anchor point 402 and 407, and, the inner spinal line of heel notch 403 is approximately: a 135 degree angle 404 relative to the plane of the sole at position 405; a 45 degree angle relative to the plane of the sole at position 406; and a 135 degree angle relative to the plane of the sole at position 407.

As seen in FIG. 7, the arch is sized such that position 406 represents the anatomically correct placement for a heel notch to secure a heel within a shoe.

As seen in FIG. 7, the arch is sized such that position 407 represents the anatomically correct placement for a shoe horn to engender entry of a foot within a shoe.

Figure 8:
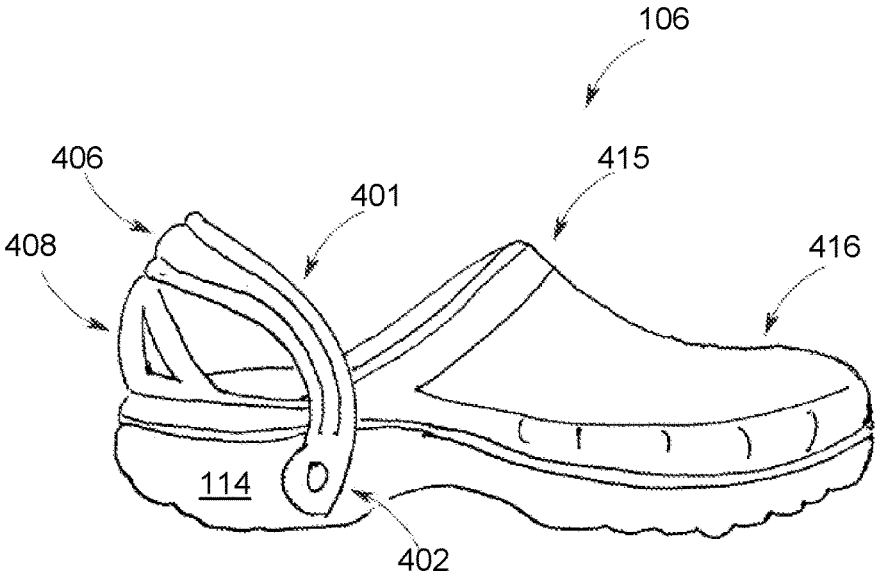
FIG. 8 presents a side view of a conceptual illustration of an alternative embodiment of a bimodal shoe, including the stadium arch bimodal structure as shown in the exemplary bimodal shoe sole of FIG. 5, in assembled state, with a morphable heel counter, in accordance with aspects of the present disclosure.

As seen in FIG. 8, in an alternative embodiment of footwear, the stadium arch in assembled form is connected to the rear of sole 114, under tension in position 406, by means of morphable heel counter 408, representing the bimodal structure in position 106. The heel counter is a morphable material, with a rearward concavity as to be further displaced rearward with applied downward directional force from above. A slit in the side(s) provide additional displacement agility. In place of the heel counter, the same mechanical function may be provided by strap(s) positioned centrally at the rear, or as dual side straps, connecting the rear sole 114 to the stadium arch under tension in position 106. The displaced stadium arch 401 in position 406 provides the rear section of a foot insertion cavity. The upper formed of the front shoe collar section 415 and toe box 416 provide the front section of a foot insertion cavity.

Figure 9:
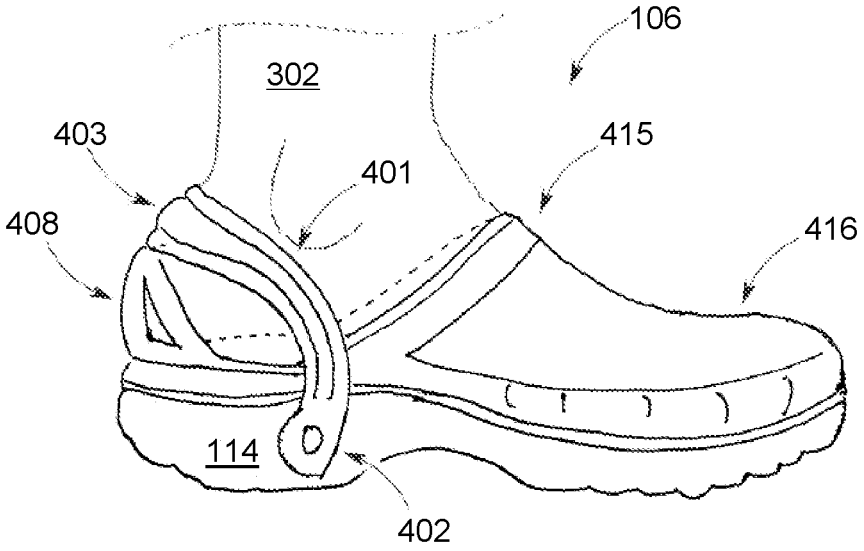
FIG. 9 presents a side view of a conceptual illustration of the alternative embodiment of a bimodal shoe of FIG. 8 with a foot secured within the shoe in its closed position, in accordance with aspects of the present disclosure.

As seen in FIG. 9, in an alternative embodiment of footwear, a user's foot 302 is positioned within the shoe. The front shoe collar section 415 of the upper is sized such that when the stadium arch bimodal structure is in position 106, the rear portion of the user's forefoot is contacted, providing a tightly clasped fit, and, the heel counter 408 and heel notch 403 of the stadium arch anchored at point 402 are sized such that when the stadium arch bimodal structure is in position 106, the heel of the foot is contacted, providing a tightly clasped fit.

Figure 10:
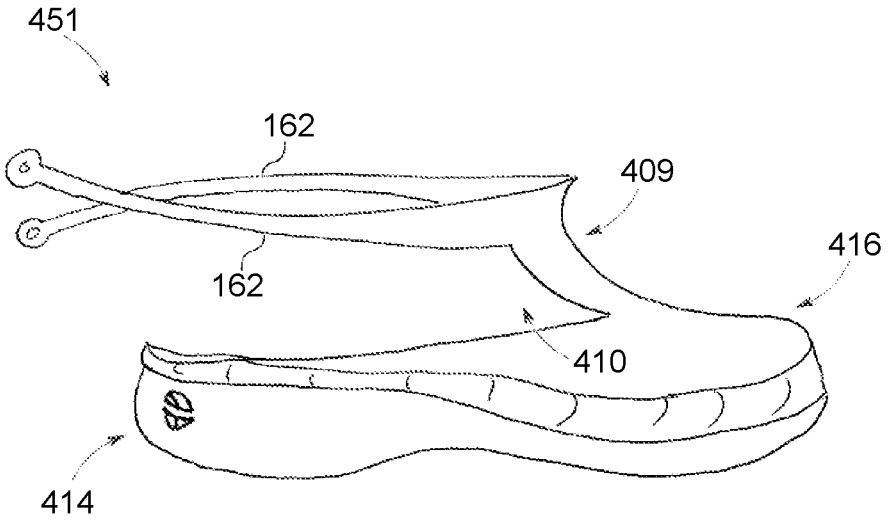
FIG. 10. presents a side perspective view of an exemplary shoe upper and shoe collar portion, with arms in manufactured state, in accordance with aspects of the present disclosure.

As seen in FIG. 10, in a manufactured state of a secondary bimodal structure 451, the front shoe collar portion of the upper in manufactured state 409 presents a native position higher than the region at which the user's forefoot is contacted with a tightly clasped fit as demonstrated in FIG. 9 with front shoe collar section 415.

As seen in FIG. 10, shoe collar portion 409 is detached from the side walls of the shoe at a middle region, and connected to the side walls and toe box at a more forward region, and a diminishing gap 410 is positioned below the shoe collar portion 409, of a size as to permit a portion of 409 occupy this gap. Dual side arms 162 extend from the upper sides of the shoe collar portion. The dual arms 162 and the top line of the shoe collar portion 409 are manufactured with a slight outward curvature, with a rearward concavity. This structure includes sufficient curvature as to provide an anatomically loose fit to the upper portion of the user's forefoot in its native, manufactured position.

As seen in FIG. 10 in a manufactured state of a secondary bimodal structure, shoe collar portion 409 with arms 162 forms an upper with the side walls and toe box 416. The upper is connected to sole 114. Sole 114 includes a vector changing mechanism 414 located at the rear sole.

Figure 11:
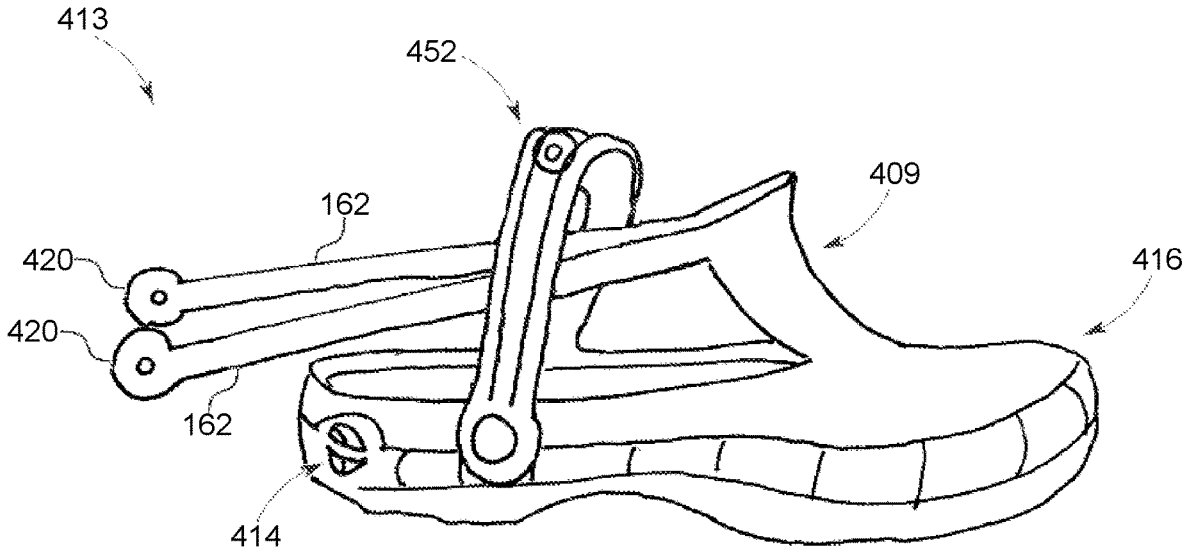
FIG. 11 presents a side perspective view of an alternative embodiment of a bimodal shoe, including the stadium arch bimodal structure as shown in the exemplary bimodal shoe sole of FIG. 5, and including the exemplary shoe upper and shoe collar portion with arms of FIG. 10, and including the vector changing device at the rear of sole, in manufactured state, in accordance with aspects of the present disclosure.

As seen in FIG. 11, in a manufactured state 413 of an alternative embodiment of footwear, bimodal structure stadium arch 401 is connected to the sole 114 at anchor points 402, and, bimodal structure shoe collar portion 409 with arms 162 are connected to the upper. The arms 162 terminate in doughnut holes 420 sized to be affixed to clasps. The upper is connected to sole 114. Sole 114 includes a vector changing mechanism 414 located at the rear sole 188. Stadium arch includes clasps 452 sized to be affixed to doughnut holes of arms 162.

Figure 12:
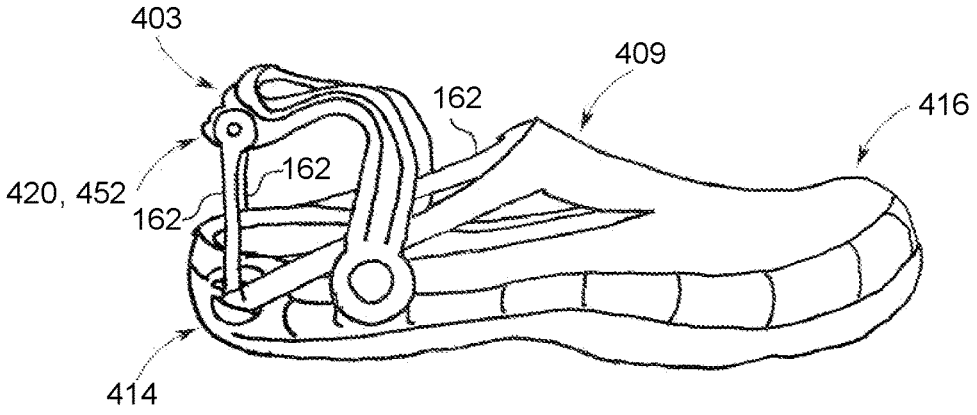
FIG. 12 presents a side perspective view of an alternative embodiment of a bimodal shoe, including the stadium arch bimodal structure as shown in the exemplary bimodal shoe sole of FIG. 5, and including the exemplary shoe upper and shoe collar portion with arms of FIG. 10, and including the vector changing device at the rear of sole, in assembled state, in accordance with aspects of the present disclosure.
Figure 13:
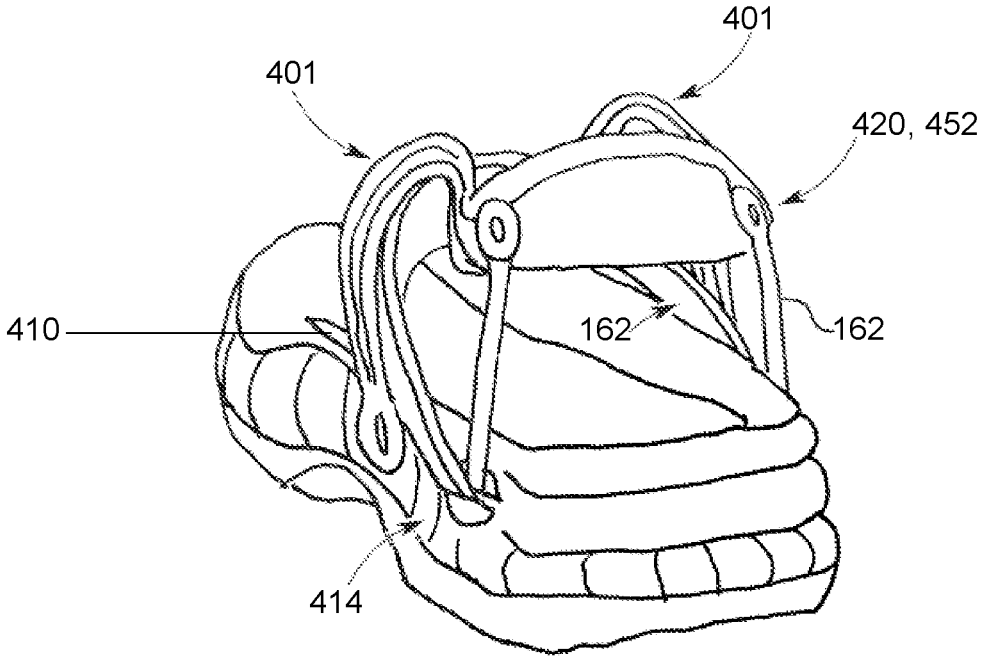
FIG. 13 presents a rear perspective view of an alternative embodiment of a bimodal shoe, including the stadium arch bimodal structure as shown in the exemplary bimodal shoe sole of FIG. 5, and including the exemplary shoe upper and shoe collar portion with arms of FIG. 10, and including the vector changing device at the rear of sole, in assembled state, in accordance with aspects of the present disclosure.

As seen in FIGS. 12, 13, in the assembled state of an alternative embodiment of footwear, shoe collar portion 409 occupying gap 410 is connected under tension via arms 162 passing through vector changing mechanism 414 to the heel notch section of stadium arch in position 406, affixed with doughnut holes 420 to clasps 420.

In conclusion, disclosed is a shoe that enables fast and easy placement and removal of shoes that is hands-free, and at the same time that permits structural support and gripping of the ankle thus permitting running and fast walking. When the user desires to remove the shoe the user may push down on their foot on the back of an opposite heel's tab to force the bimodal structure and/or the shoe to pop or lock open. Downward pressure of a user's foot heel entering the shoe may push the bowed ends back to a reverse concave-convex condition, to snap back into the non-inverted position. A semi sphere may have a similar ability to snap into either an inverted or non-inverted position upon receiving similar forces. It is to be understood that the bimodal shoe may include multiple bimodal structures described above in multiple locations, as appropriate.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A shoe, comprising:

a sole structure comprising opposing sides and a footbed for a wearer's foot;

an upper comprising a front collar section surrounding a top portion of the foot, the front collar section is made of a flexible, elastic material;

a heel counter surrounding a heel of the foot;

a stadium arch having an single, bendable, arched band with terminating ends and an apex, the ends cross the front collar section and are anchored to the sides of the sole, below a plane of the footbed, the apex of the band has a anatomically positioned heel notch with a slight forwardly concavity for securing the heel of the foot and is anchored to a top of the heel counter, the stadium arch is made of flexible, elastic material having stored tension at the heel notch, and higher tension at its ends, the stored tension urging the heel notch being rotated upwardly and forwardly of a rear sole area of the sole, wherein a gap exist between the stadium arch and the heel counter; and wherein the upper includes an opening between the front collar section and the stadium arch for inserting the foot;

wherein the opening for inserting of the foot expands to a first opening at a first position with the heel notch of the stadium arch being rotated downwardly and rearwardly relative to the rear sole area of the sole, upon downward pressure from the foot, so that when the stadium arch is flexed in the first position the heel notch is positioned more rearwardly than the heel of the foot, presenting a shoe horn shape so as to permit the foot to slide into the shoe, the first opening being larger than the second opening, to facilitate entry and exit of the foot; and wherein the opening for inserting of the foot contracts to a second opening at a second position when the stadium arch is rotated upwardly and forwardly relative to the rear sole area of the sole, stored tension of the stadium arch returning the heel notch to the assembled second position, the heel notch positioned at the heel, and the second opening is smaller than the first opening, to secure the foot within the shoe, wherein the shoe collar portion of the upper is positioned as to tightly grip an upper forefoot of the foot when the foot is secured in the shoe with the stadium arch in the second position.

2. The shoe of claim 1, wherein the stadium arch partially spans both the heel counter and the sole.

3. The shoe of claim 1, wherein each of the terminating ends of the stadium arch include a hole or a clasp.

* * * * *